United States Patent [19]

Kemp et al.

[11] 4,339,137

[45] Jul. 13, 1982

[54] TETHERED BALL AND TUBE TARGET

[76] Inventors: Kenneth Kemp, c/o George Spector, 3615 Woolworth Bldg., 233 Broadway; George Spector, 3615 Woolworth Bldg., 233 Broadway, both of New York, N.Y. 10007

[21] Appl. No.: 21,013

[22] Filed: Mar. 16, 1979

[51] Int. Cl.[3] ..... A63B 65/00

[52] U.S. Cl. ..... 273/331

[58] Field of Search ..... 273/329, 330, 331, 153 S, 273/413, 332, 333

[56] References Cited

U.S. PATENT DOCUMENTS 3,856,305 12/1974 Vetter ..... 273/331

FOREIGN PATENT DOCUMENTS 41792 4/1910 Fed. Rep. of Germany ..... 273/331

280673 11/1913 Fed. Rep. of Germany ..... 273/329

*Primary Examiner*—Richard C. Pinkham

*Assistant Examiner*—T. Brown

[57] ABSTRACT

A puzzle that includes a transparent box having a small cup mounted upon its floor and a small bead suspended on a thread from a ceiling of the box, the box being shaken manually by a player in attempting to get the bead into the cup, and in a modified design the cup and the thread being fastened on manually rotatable platforms.

3 Claims, 5 Drawing Figures

Fig. 1
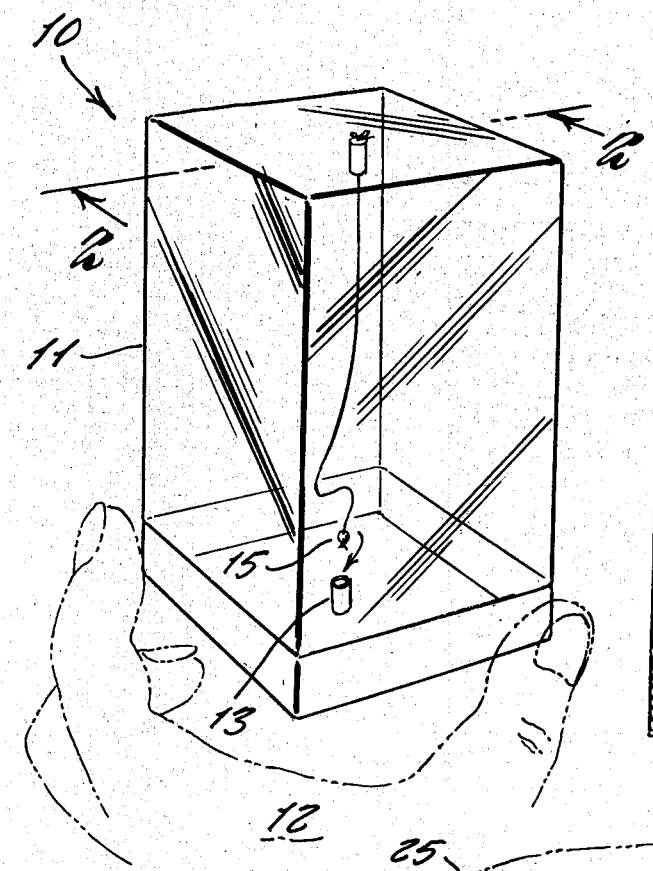
Fig. 2
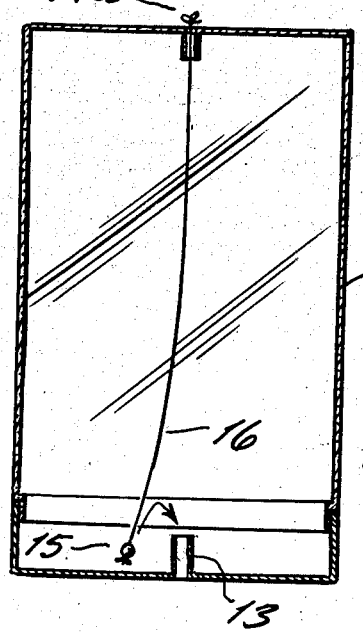
Fig. 3
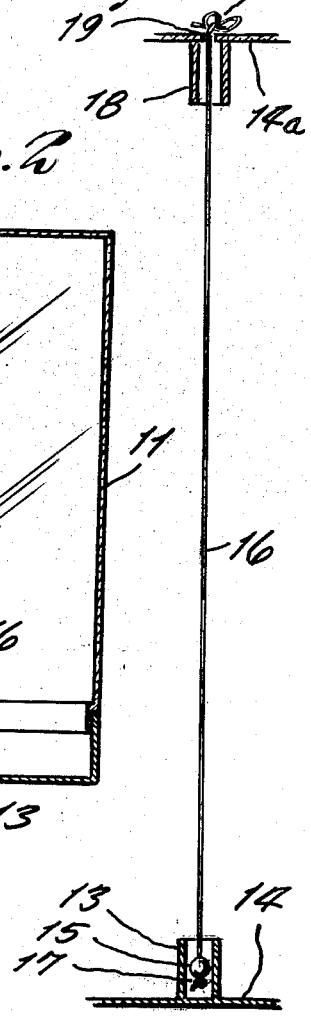
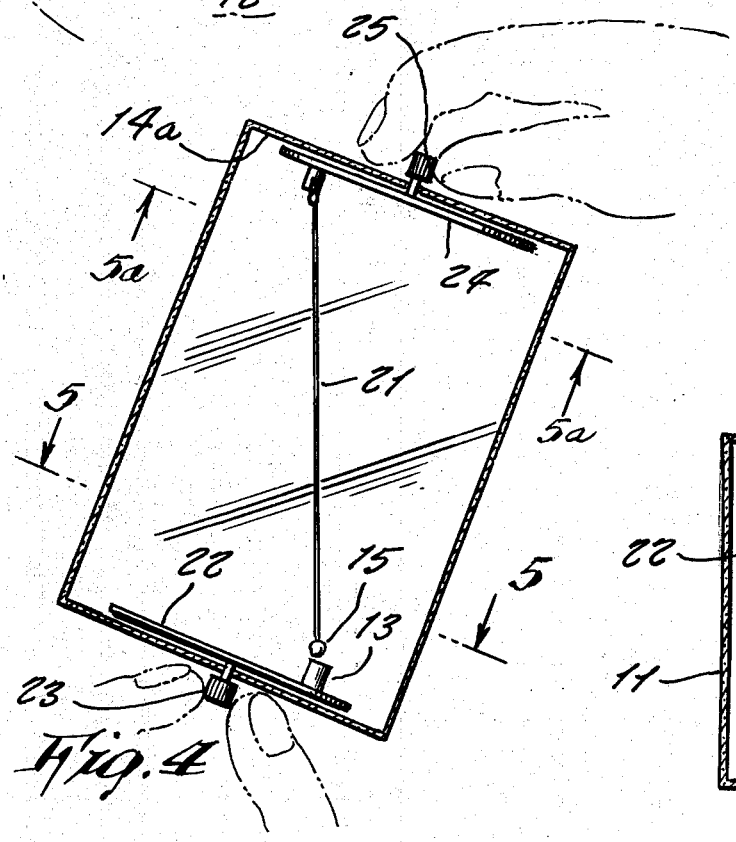
Fig. 4
Fig. 5
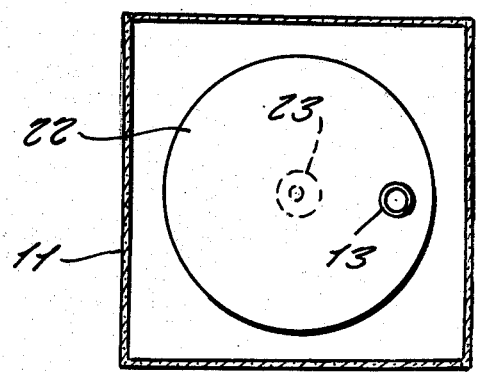

TETHERED BALL AND TUBE TARGET

This invention relates generally to puzzle game devices.

A principal object of the present invention is to provide a new type of puzzle which can be made in either an easy-to-solve or in a more difficult design so that it will appeal to all players.

Another object is to provide a puzzle which can be made in various sizes so that it can be conveniently handled in use, and which can be comfortably carried about by a player.

Still a further object is to provide a puzzle which is different from other puzzles that are now being marketed, so that its novelty will attract prospective purchasers.

FIG. 1 is a perspective view of one design of the invention, and which includes an exposed knot of the suspended thread on top of the case in order that it can be pulled to lift above the lower tube so to allow a modified manner of playing the puzzle by persons who cannot succeed to get the bead inside the tube by flicking the puzzle in a hand.

FIG. 2 is a cross sectional view on line 2—2 of FIG. 1.

FIG. 3 is an enlarged detail thereof showing the bead inside the lower tube.

FIG. 4 is a side cross sectional view of another design of the invention in which both top and bottom tubes are adjustable in position so that the bead on a stiff wire can be gotten into the lower tube, this form of the puzzle being more difficult as both upper and lower knobs must be rotated at a same time so to succeed.

FIG. 5 is a cross sectional view on line 5—5 of FIG. 4, it being understood that the opposite end 5*a*–5*a* is a same.

Referring now to the drawing in greater detail, and more particularly to FIGS. 1 through 3 thereof, the reference numeral 10 represents a keke torture chamber according to the present invention wherein there is a rectangular hollow box 11 made of a rigid plastic that is transparent in order to allow seeing thereinto. The box preferably measures approximately 58 by 58 by 85 millimeters overall, so that it can be conveniently held in a players hand 12.

A small cup or tube 13 is fastened upon a center of a floor 14 of the box.

A bead 15 is threaded on a thread 16 and rests upon a knot 17 formed at a lower end of the thread, the upper end of the thread being suspended from a center of a top or ceiling 14*a* of the box. The size of the bead is such so that it can fit inside the tube 13. The length of the thread is such so that the bead clears the floor as it is freely suspended on the thread.

When playing with the puzzle, a player attempts to get the bead inside the tube, from the position outside the tube shown in FIG. 2. This is accomplished by holding the device in the hand as shown in FIG. 1, and flicking it, so that the bead jumps up higher than the upper edge of the tube and drops inside the tube, as shown in FIG. 3.

While any form of securement may be used to suspend the thread from the ceiling, the drawing shows one example of it extending through an upper tube 18 and through a hole 19 in the ceiling top wall, where a knot 17*a* formed on the upper end of the thread rests on top of the top wall.

In FIGS. 4 and 5, another design 20 of the invention demands more skill for being solved. In this design, the bead is secured to a lower end of a stiff wire 21 instead of a flexible thread. The cup or tube 13 is mounted in an eccentric position upon a rotatable platform 22 integral with knob 23 extending out a bottom of the box so to be manually rotatable. The upper end of the wire 21 is attached pivotably free to an eccentric position of a likewise rotatable platform 24 under the ceiling and is integral with a knob 25 extending out a top of the box so to be manually rotatable. The length of the wire is such so that when the platforms are rotated as shown in FIG. 4 with the eccentric positions being maximum distances apart, then the freely suspended bead clears an upper edge of the lower tube. In such position, the box is necessarily tilted as shown. As each knob is slowly rotated and the box is gradually tilted toward upright position, the distance between the eccentric positions is shortened so that the bead can be lowered into the tube. This form of the puzzle required more skill for each hand to turn a separate knob while the box angle is gradually changed.

What is claimed is:

1. A puzzle, comprising in combination, a hollow transparent rectaugular box having a ceiling and a floor including a bead suspended from the ceiling and a tube mounted above said floor, said tube being adapted to receive and retain therein said bead, including means for adjustably suspending the bead in said box from said ceiling, whereby the point of suspension is movable.

2. A puzzle as in claim 1 wherein said means comprise an aperture through said ceiling with an actuating member extending through said ceiling adapted to adjustably suspend said bead therefrom, said bead being suspended by a thin flexible member in further combination with means for moving the tube relative to the ceiling and floor.

3. A puzzle as in claim 2 wherein the last said means comprises a rotatable platform on said floor and the first said means includes a rotatable platform secured to said actuating member each platform having external means for manual rotation, said tube being mounted on the first said platform eccentric relative to said suspenced bead said bead suspending means being of sufficient length to permit said bead to enter said tube at all tube positions.

* * * * *